United States Patent [19]

Orr et al.

[11] 4,251,337

[45] Feb. 17, 1981

[54] NOVEL TITANIUM-CONTAINING ELECTRODE AND ELECTROLYTIC PROCESSES EMPLOYING SAME

[75] Inventors: Newell H. Orr; Arthur L. Forrest, both of Fairfield, N.J.

[73] Assignee: Titanium Industries, Fairfield, N.J.

[21] Appl. No.: 46,601

[22] Filed: Jun. 8, 1979

[51] Int. Cl.[3] ..... C25C 1/00; C25C 17/02

[52] U.S. Cl. ..... 204/105 R; 204/286

[58] Field of Search ..... 204/12, 281, 286, 105 R, 204/105 M, 106, 109

[56] References Cited

U.S. PATENT DOCUMENTS 3,857,774 12/1974 Morton ..... 204/288

4,014,763 3/1977 Cowe ..... 204/286

OTHER PUBLICATIONS

Engineering and Mining Journal, Apr. 1975 p. 101.

Welding Handbook, Sixth Edition, 1971 Section Three Part B, pp. 51.1–51.28.

*Primary Examiner*—T. M. Tufariello

*Attorney, Agent, or Firm*—Karl F. Ross

[57] ABSTRACT

A new electrode comprising a titanium sheet, a copper hanger bar and an explosion-bonded metallurgical junction between said sheet and said bar bonding same together is disclosed as well as a process for the preparation thereof. Also disclosed are new electrolytic processes, as well as a new electrolytic cell.

2 Claims, 3 Drawing Figures

NOVEL TITANIUM-CONTAINING ELECTRODE AND ELECTROLYTIC PROCESSES EMPLOYING SAME

FIELD OF THE INVENTION

This invention relates to electrodes used in electrochemical cells for the production of metallic products as well as to a method of preparing such electrodes. The invention also relates to a new electrolytic cell and to a new method of operating an electrolytic cell. More particularly the invention relates to cathodes used for the electrorefining of copper. The invention also relates to other cathodic applications, such as the production of manganese, gold or silver. Lastly the invention also relates to anodic applications, such as the production of manganese dioxide.

BACKGROUND OF THE INVENTION

For many years, the final step in producing copper of high purity has been electrolytic. Copper is commercially available on a world scale as "cathode copper", the product of this electrolytic step. Cathode copper has purity of 99.9% Cu or greater, and can be worked into products such as wire or tubing which are extremely reliable in service because of their high purity.

The most common procedure for producing cathode copper is to cast as an initial step, copper anodes from the molten output of a smelter. These anodes typically contain 95% Cu. They are gradually dissolved in cells in which the electrolyte is sulfuric acid and the cathodes are thin sheets (about 25 or 30 mils in thickness) of high purity copper. These thin "starter sheets" are also produced electrolytically and the common practice for their production is to used lead anodes in an electrolyte containing copper sulfate and free sulfuric acid and titanium cathodes. This invention relates to such titanium cathodes, sometimes referred to as "mother blanks", used for production of starter sheets.

A titanium mother blank is a sheet of high purity titanium, typically 36 inches wide by 40 inches long and 0.125 inches in thickness. It is suspended from a copper hanger bar having typical dimensions of 48"×1.75"×0.75." It is essential that the joint between titanium and copper be strong mechanically and also electrically and that these properties remain constant for a period of years. Cells containing titanium mother blanks are operated at 140°-150° F. and low current density is used to deposit very fine grained sheets of pure copper on both sides of the immersed portion of the titanium. The mother blanks are removed from the cells at the end of 24 hours and the copper deposits are removed in the form of complete sheets, 25 or 30 mils in thickness, which resemble highly flexible foils. Titanium has evolved over recent years as the preferred material for cathodes for production of starter sheets because it can be plated uniformly with coppor and the deposit can be stripped readily and completely.

Titanium is commonly welded to itself by electrical resistance welding or by fusion welding. These methods can not be used to join titanium to copper (or to most other metals) because at welding temperatures, titanium forms intermetallic compounds with copper. These brittle compounds preclude formation of a mechanically sound joint. Titanium sheets have been joined to copper hanger bars using rivets or nuts, bolts and washers. Through holes are provided in both the sheet and hanber bar and the fasteners are closed under controlled conditions. The use of fasteners has the advantage that construction of the cathode is relatively inexpensive. A disadvantage of fasteners is that one or more fasteners on a cathode may loosen in time due to daily mechanical handling of the cathode plus daily thermal cycling from 140°-150° F. to ambient temperature. Loose fasteners result in imperfect electrical contact between the titanium sheet and copper hanger bar and this causes uneven deposition of copper resulting in imperfect starter sheets.

Titanium sheets have also been joined to copper hanger bars without use of fasteners. This is done by first making a titanium sheathed copper hanger bar by co-extrusion of the two metals at elevated temperature. The temperature is such (400° to 800° C.) that the two metals deform plastically and intimate contact results but the temperature is below that at which metal-to-metal welding, accompanied by deleterious formation of inermetallic compounds, occurs. The titanium sheet is then joined to the titanium sheath of the hanger bar by conventional welding e.g., by electrical resistance welding. This adjoinment method is the subject of U.S. Pat. No. 3,857,774, which teaches that cathodes made in this manner have more stable electrical characteristics than those made with rivets or nuts and bolts. A disadvantage of co-extruded hanger bars is that they are relatively expensive due to the capital cost of the massive equipment necessary for their manufacture. A second disadvantage is that the co-extrusion process makes best use of both metals when the copper core is completely sheathed by titanium. Using January, 1979 prices, copper costs $0.75 per pound and titanium costs $6.50 per pound.

To the extent that titanium is used in any area other than that to which the titanium sheet is to be welded, the co-extrusion process is wasteful of this relatively expensive metal.

OBJECTS OF THE INVENTION

It is an object of this invention to provide an electrode containing a titanium-to-copper joint by welding these dissimilar metals, with the resultant joint having excellent properties of mechanical strength and electrical conductivity.

It is also an object of this invention to provide an improved titanium cathode of "all-welded" construction based on this titanium-to-copper joint.

It is a further object of this invention to obtain such a titanium cathode by a manufacturing method which is relatively inexpensive using little in the way of capital equipment.

SUMMARY OF THE INVENTION

These objects are obtained according to the present invention in that the new electrodes comprise a titanium sheet, a copper hanger bar and an explosion bonded metallurgical junction between said sheet and said bar bonding same together. Explosion bonding is a welding process in which similar or dissimilar metals are joined very rapidly by detonation of an explosive. In the case of dissimilar metals such as titanium and copper, formation of undesirable intermetallic compounds is minimized because the fusion zone of the interface of the two metals is at an elevated temperature for only a brief period of time, measured in microseconds. In carrying out the process to produce the new electrodes, a relatively thin piece of titanium may be placed in contact with a relatively thick piece of copper. A carefully controlled amount of explosive is placed over the titanium, and the charge is detonated. Before detonation and shortly thereafter, the two metals are at ambient temperature. During detonation, a very high temperature is reached at the titanium-copper interface (explosion bonded metallurgical junction). This temperature, together with the extremely good metal-to-metal contact caused by the pressure of the explosiion, causes interdiffusion of the two metals. The result is a metallurgical bond relatively free of brittle intermetallic compounds.

According to one feature of the invention an electrode comprising a titanium sheet, a copper hanger bar and an explosion-bonded metallurgical junction between the sheet and the bar bonding same together is prepared by directly explosion bonding the titanium sheet to the copper hanger bar.

According to another feature of the invention a titanium strip is interposed between the copper hanger bar and the titanium sheet. The titanium strip is bonded to both the copper hanger bar and to the titanium sheet and forms at least part of the explosion-bonded metallurgical junction with the copper. Preferably the titanium strip forms an explosion-bonded metallurgical junction with the copper hanger bar and a fusion bond weld with the titanium sheet. In another feature of the invention the titanium strip forms an explosion-bonded metallurgical junction with the copper hanger bar and a resistance bond weld with the titanium sheet.

Another feature of the invention involves a new electrolytic cell. The electrolytic cell includes an anode and a cathode, at least one of which comprises a titanium sheet, a copper hanger bar and an explosion-bonded metallurgical junction between the sheet and the bar. The new titanium anode and/or cathode included in the new electrolytic cell can be prepared according to the process described immediately above.

Lastly the invention includes a new method of operating an electrolytic cell. In the new method an electrolytic cell is formed containing as anode and a cathode at least one of which comprises a titanium sheet, a copper hanger bar, and an explosion bonded metallurgical junction between the sheet and the bar bonding same together.

In the case where it is the cathode which contains a titanium sheet, a copper hanger bar and an explosion-bonded metallurgical junction between the sheet and the bar bonding same together, the following electrolytic processes may be conducted. An electrolyte solution comprising a salt of either respectively copper, gold, silver or manganese is provided. Next an electric current is passed through the electrolyte solution. Then respectively copper, gold, silver or manganese is recoveered on the surface of the cathode.

In the case where it is the anode which contains a titanium sheet, a copper hanger bar and an explosion bonded metallurgical junction between the sheet and the bar bonding same together, the following electrolytic process may be conducted. An electrolyte solution comprising manganese (II) or (III) sulfate or mixtures of same is provided. Next an electric current is passed through the electrolyte solution. Manganese dioxide is then recovered on the surface of the anode.

The explosion bonding process is presently used on a commercial scale. One source in the United States is E.I. DuPont de Nemours and Company. Their brochure "Metal Cladding at Du Pont" describes the process and facilities. All of the titanium-to-copper joints described in the example hereinafter were made by a commerical explosion bonding source.

BRIEF DESCRIPTION OF THE DRAWING

The above and other objects, features and advantages will become readily apparent from the following, reference being made to the following accompanying drawings in which FIG. 1 discloses a front-view perspective of the new electrode where an explosion bonded metallurgical junction is formed between a titanium sheet and a copper hanger bar.

DETAILED DESCRIPTION OF THE DRAWINGS

Figure 1:
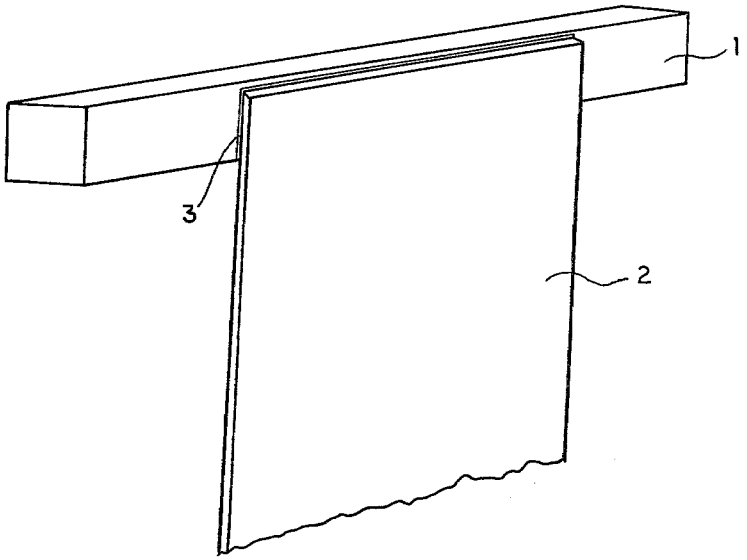

In FIG. 1 a copper hanger bar 1 is joined to a titanium sheet 2 by an explosion bonded metallurgical junction 3.

Figure 2:
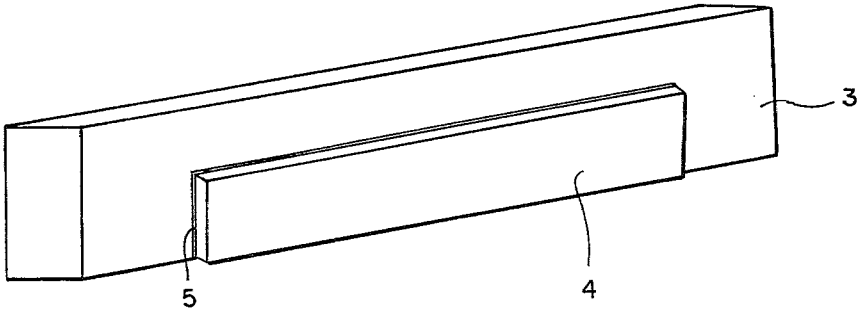
FIG. 2 is a front view perspective of a copper hanger bar with a titanium strip explosion bonded thereto to form a metallurgical junction with said copper hanger bar.

In FIG. 2 a copper hanger bar 3 is joined to a titanium strip 4 by an explosion bonded metallurgical junction 5.

Figure 3:
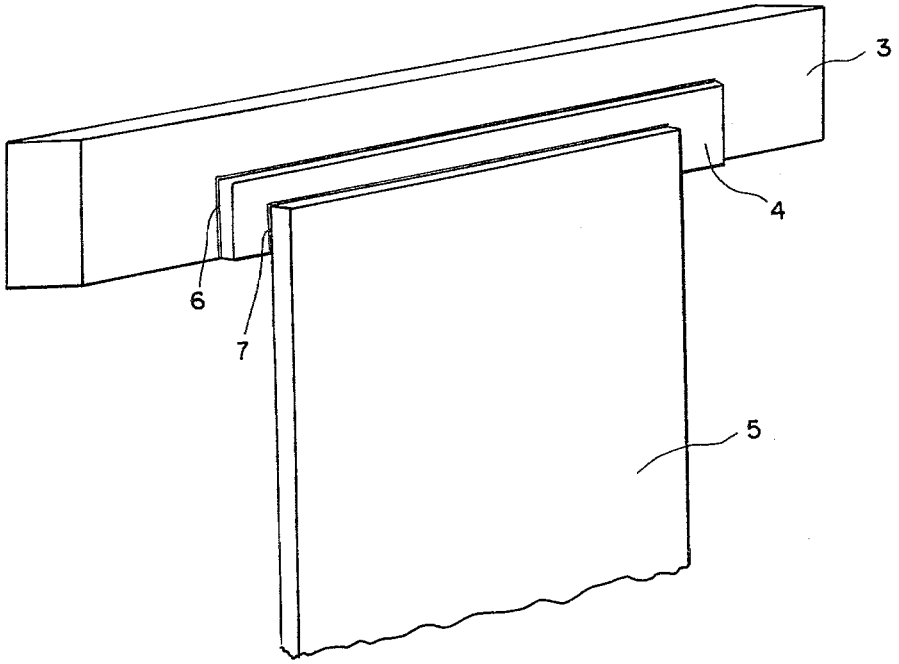
FIG. 3 is a front view perspective of the new electrode with a titanium strip explosion bonded to form a metallurgical junction with a copper hanger bar and with a titanium sheet bonded to form a titanium-titanium bond with the titanium strip.

In FIG. 3 a copper hanger bar 3 is joined to a titanium strip 4 by an explosion bonded metallurgical junction 6. A titanium sheet 5 is bonded to the titanium strip 4 by fusion weld or resistance weld 7.

The examples which follow refer mainly to titanium cathodes of the type use to produce starter sheets in the copper industry. Electrolytic production of gold is also exemplified according to Example 1. Titanium cathodes are also used in electronlytic production of manganese and silver and this invention encompasses improved cathodes for production of these metals as well. Titanium anodes are used in electrolytic production of manganese dioxide, and the improved electrode of this invention can also be used to make this anodic product.

EXAMPLE 1

In the final step in producing gold of high purity, this metal is plated on titanium cathodes. When a suitable thickness of gold has been deposited, the cathodes are removed, rinsed and the gold deposit is removed manually. The gold is then melted and poured into molds to produce the gold ingots of commerce. Gold is produced on a very small scale and the electrolytic cells used in its production are correspondingly small. Titanium cathodes used in these cells typically have an immersed area of 8×8".

A titanium cathode was made as follows: A sheet of commercially pure titanium metal was cut to dimensions of 11×8×0.078". A bar of electrolytic grade hard copper was extruded to dimensions of 14 by 1×1". A steel fixture was used to hold the 8" dimension of the titanium sheet against a 1" dimension of the copper bar. The sheet was centered to provide a 3" extension of the copper bar on both ends. A sheet of flexible explosive was cut to 1×8". This was placed in contact with the titanium sheet where it contacted the copper bar. An electrically actuated detonator was placed in contact with the explosive. The explosive was fired to produce the finished cathode. This is shown as in FIG. 1. In this case, the copper hanger bar 1 has the titanium sheet 2 welded to it over an area of 1×8".

Titanium cathodes made in this way had excellent titanium-to-copper joints over 85 to 90% of the 1×8" contact area. This was determined using an ultrasonic technique. Electrical measurements showed excellent conductivity across the titanium-copper interface. The physical properties of joints made in this way showed no change after use for one year in cells in a gold refinery.

EXAMPLE 2

Titanium cathodes used for production of copper starter sheets can be made in the manner described in Example 1. However, both the titanium sheets and copper hanger bars are large in size and it is cumbersome to place them in fixtures for the explosion bonding step. It has been found more convenient to make these cathodes in two steps. In the first step, a strip of titanium is welded by explosion bonding to the copper hanger bar. The dimensions of this strip are selected to use a minimum amount of this relatively expensive material. In the second step, a titanium sheet is welded to the titanium strip.

Titanium cathodes were made using two welding steps according to FIG. 2. A copper hanger bar 3 has dimensions of 48×1.75×0.75". A strip of commercially pure titanium 4 has dimensions of 38×1×0.078". This is joined by explosion bonding to one 1.75" surface of the copper hanger bar. The quality of this weld was confirmed by ultrasonic and electrical tests.

As shown in FIG. 3, a sheet of commercially pure titanium 5 is placed in contact with the hanger bar of FIG. 2. This sheet has dimensions of 36×40×0.125". The 36" dimension is centered on the 38" titanium strip. The edge of the titanium sheet is centered on the one inch dimension of the titanium strip 4. Electrical welding equipment was used in an argon atmosphere to apply a continuous fillet weld (not shown) along the 36" dimension of the titanium sheet. Commercially pure titanium welding wire, 0.093" in diameter, was used as the filler metal.

Cathodes made by this two step welding process were found to perform well in daily use in a copper refinery.

EXAMPLE 3

Titanium cathodes of the same dimensions as those described in Example 2 were made by a variation of the two step welding process of that Example. The final welding of the titanium sheet to the titanium strip was done by electrical resistance welding. Resistance welding is somewhat faster that fusion welding and does not require an argon atmosphere. However, because the resistance welds cannot be inspected visually, quality control testing is time consuming. Over all, fusion welding is the preferred method when the two step process is used in carrying out this invention.

We claim:

1. A method of operating an electrolytic cell which comprises the following steps:

(a) preparing an electrode by:

($a_1$) explosion bonding a titanium strip to a copper hanger bar to form an explosion bonded metallurgical junction between said titanium strip and copper hanger bar; and ($a_2$) fillet welding a titanium sheet to said titanium strip to form a fusion bond weld thereinbetween;

(b) assembling an electrolytic cell comprising an anode and the electrode prepared according to step (a) as a cathode;

(c) further providing an electrolytic solution in said cell comprising a salt of either respectively copper, gold, silver or manganese;

(d) passing an electric current through the electrolytic solution provided in step (c) in said cell; and (e) recovering respective copper, gold, silver or manganese on the surface of the cathode.

2. The method defined in claim 1, step (c), wherein the electrolytic solution comprises a salt of copper and wherein copper is recovered during step (e) on the surface of the cathode.

* * * * *